US008936472B1

(12) United States Patent
Gibboney, Jr.

(10) Patent No.: US 8,936,472 B1
(45) Date of Patent: Jan. 20, 2015

(54) MAGNETIC REPULSION-BASED COUPLING IN AN ELECTRICAL CONNECTOR

(71) Applicant: James W. Gibboney, Jr., Conyers, GA (US)

(72) Inventor: James W. Gibboney, Jr., Conyers, GA (US)

(73) Assignee: Christmas Northeast, Inc., Trumbull, CT (US)

( * ) Notice: Subject to any disclaimer, the term of this patent is extended or adjusted under 35 U.S.C. 154(b) by 0 days.

(21) Appl. No.: 13/792,284

(22) Filed: Mar. 11, 2013

Related U.S. Application Data

(60) Provisional application No. 61/722,467, filed on Nov. 5, 2012.

(51) Int. Cl.
*H01R 11/30* (2006.01)
*H01R 13/60* (2006.01)
*H01R 13/62* (2006.01)

(52) U.S. Cl.
CPC ..... *H01R 13/6205* (2013.01)
USPC ..... 439/39; 439/677

(58) Field of Classification Search
CPC ..... H01R 13/6205; H01R 11/30
USPC ..... 439/38, 39, 879, 677–679
See application file for complete search history.

(56) References Cited

U.S. PATENT DOCUMENTS

| | | | | |
|---|---|---|---|---|
| 2,573,920 | A * | 11/1951 | McLeod | 439/38 |
| 3,706,882 | A * | 12/1972 | Eby | 439/36 |
| 6,109,984 | A * | 8/2000 | Tsou | 439/879 |
| 6,575,764 | B1 * | 6/2003 | Reipur | 439/352 |
| 6,670,583 | B2 * | 12/2003 | Kara | 439/39 |
| 7,658,613 | B1 * | 2/2010 | Griffin et al. | 439/39 |
| 8,272,876 | B2 * | 9/2012 | Schultz | 439/38 |
| 2010/0181841 | A1 | 7/2010 | Azancot et al. | |
| 2011/0159706 | A1 * | 6/2011 | Wu | 439/39 |
| 2011/0204845 | A1 | 8/2011 | Paparo et al. | |
| 2012/0242440 | A1 | 9/2012 | Fullerton et al. | |
| 2012/0295451 | A1 * | 11/2012 | Hyun-Jun et al. | 439/39 |

FOREIGN PATENT DOCUMENTS

WO WO 2011/106506 A2 1/2011

* cited by examiner

*Primary Examiner* — Felix O Figueroa
(74) *Attorney, Agent, or Firm* — Michael A. Mann; Nexsen Pruet, LLC

(57) ABSTRACT

A magnetic repulsion-based coupler for an electrical connector includes a housing with two passages formed therein, a male terminal having a magnetic top on one of the passages, and a female terminal having a top made of a material attracted to a magnet in the other passage of the housing. Two such housings form an electrical connector for passing electric power from one conductor to another while preserving polarity when the couplers self-align. Self-alignment occurs when their opposing male terminals repel each other and are each attracted to the female terminals of the opposing couplers. Each passage in the housing of a coupler is formed to receive only the male or female terminal.

18 Claims, 5 Drawing Sheets

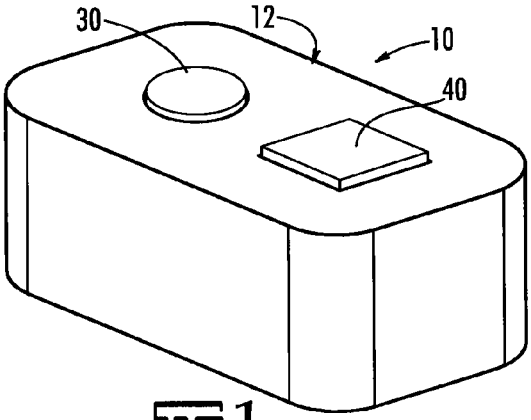
FIG.1
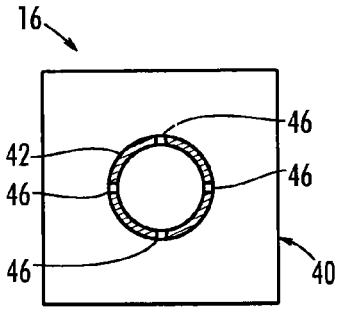
FIG.5A
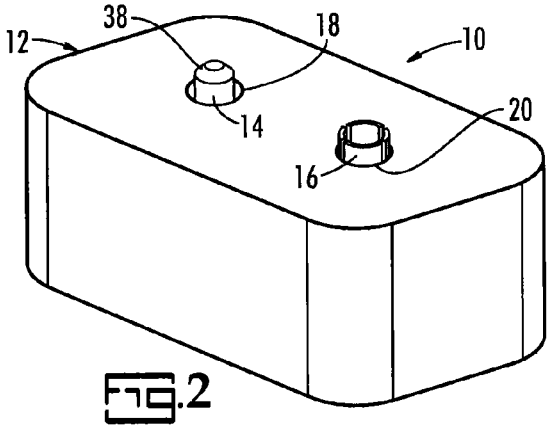
FIG.2
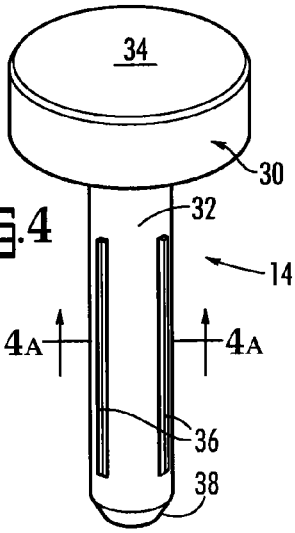
FIG.4
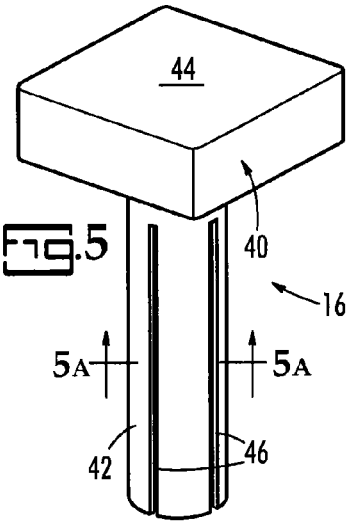
FIG.5
FIG.4A
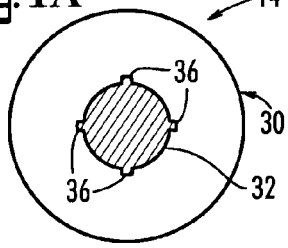

MAGNETIC REPULSION-BASED COUPLING IN AN ELECTRICAL CONNECTOR

PRIORITY CLAIM

The priority benefit of U.S. Provisional Patent Application Ser. No. 61/722,467, filed Nov. 5, 2012, which is incorporated herein by reference in its entirety, is claimed.

BACKGROUND OF THE INVENTION

The present invention relates to electrical couplers of the type used to enable two electrical conductors to be connected so that electricity can pass from one to the other. A typical example of a prior art electrical connector is the familiar two-part, plug and socket found in homes, commercial establishments and industrial facilities for delivering alternating electrical current. The male plug has electrically conducting prongs that are inserted into recesses formed in the female socket. Inside those recesses are electrical terminals that come into engagement with the male prongs when the plug is inserted into the socket to thereby provide a conductive path for electricity. When the male prongs are in contact with the electrical terminals inside the female socket, electricity can pass from one conductor to the other across the coupled plug and socket connector.

The arrangement and number of plugs and recesses vary to accommodate polarity, voltages and ground connectors.

SUMMARY OF THE INVENTION

The present invention is a universal coupler that, together with a second universal coupler forms an electrical connector. Each coupler is identical and interchangeable and each carries two different electrical terminals. Importantly, when a first coupler is brought near a second coupler, the first will automatically orient itself with respect to the second coupler and then connect so that the electrical terminals are brought into electrical contact with the right polarity. Automatic self-orientation is achieved by selecting a magnetic material for the top of one of the two electrical terminals of a coupler; the top of the other electrical terminal of the same coupler is made of a metal attracted to a magnet. Therefore, as the second coupler is brought close to the first, the magnetic tops of the terminals of the two couplers repel each other and but each is drawn toward the top of the other coupler. As a result, the two couplers of the electrical connector rotate into self-alignment coupling with the correct orientation for preserving polarity and passing current.

BRIEF DESCRIPTION OF THE DRAWINGS

The accompanying drawings, which are incorporated in and form a part of the specification, illustrate preferred embodiments of the present invention and, together with the description, disclose the principles of the invention. In the drawings:

FIG. 1 illustrates a top perspective view of the top of a coupler according to an embodiment of the present invention;

FIG. 2 is a bottom perspective view of the coupler of FIG. 1;

FIG. 4 is a perspective view of the male terminal of a coupler, according to an embodiment of the present invention;

FIG. 4A is a cross-sectional view taken along lines 4A-4A of FIG. 4;

FIG. 5 is a perspective view of a female terminal of a coupler, according to an embodiment of the present invention;

FIG. 5A is a cross-sectional view taken along lines 5A-5A of FIG. 5;

FIG. 7B illustrates the partial realignment of terminals of the top and bottom couplers, and FIG. 7C illustrates the complete alignment of the two couplers;

DETAILED DESCRIPTION OF EMBODIMENTS OF THE INVENTION

Figure 3:
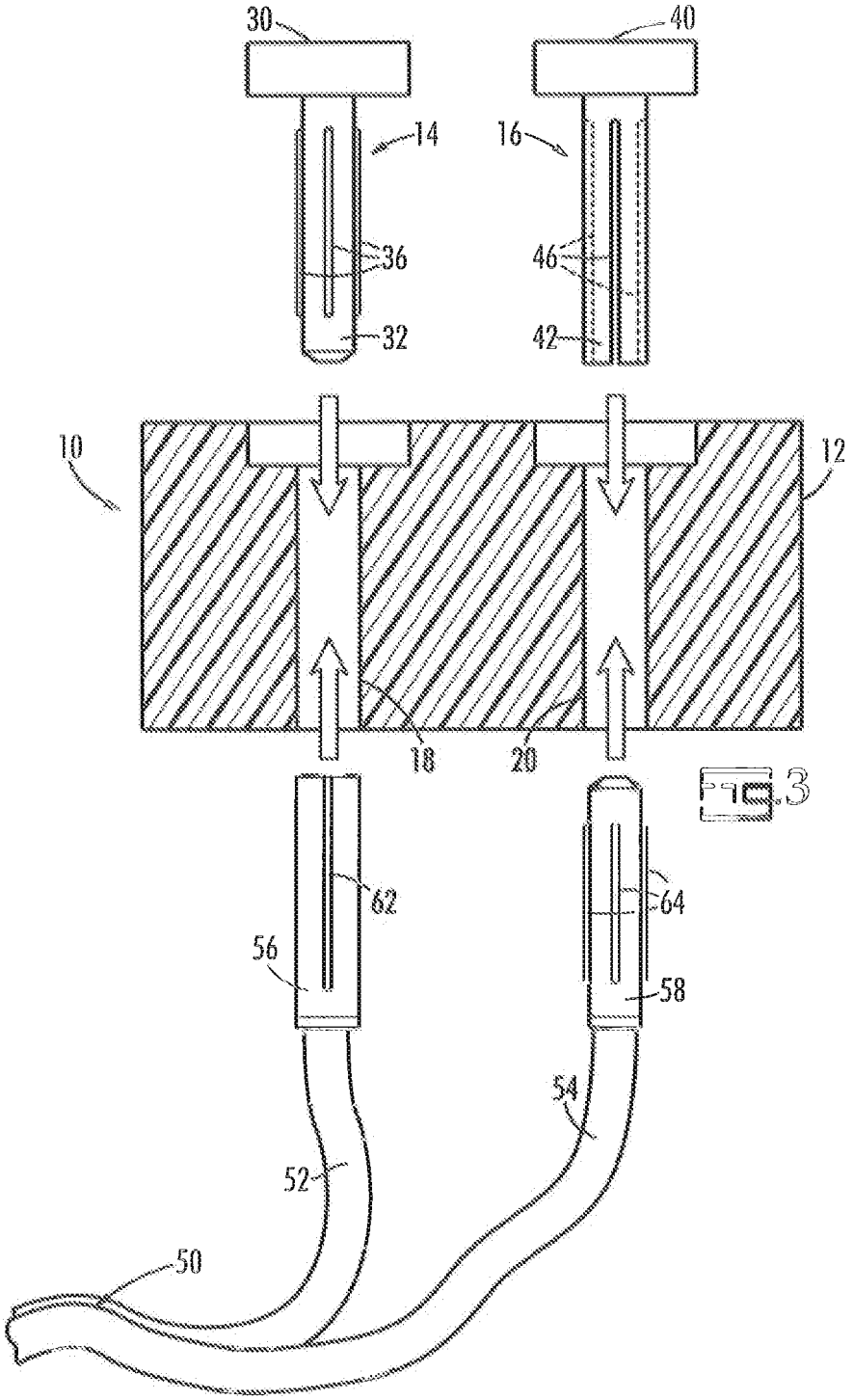
FIG. 3 is a cross-sectional exploded view of a coupler and its connection to a source of power terminating in fittings that match the terminals of the coupler shown, according to an embodiment of the present invention.

The present invention is a magnetic repulsion-based coupling in an electrical connector. The connector enables the electrical connection of one pair of electrical conductors to a second pair of electrical conductors in a way that the connection can be established and broken, repeatedly, at the convenience of the user. The connector has two parts, referred to herein as couplers, which are brought into engagement, or coupled, to allow the electrical current in one pair of electrical conductors to flow through the electrical connector formed by the engaged couplers to the second pair of conductors.

Each coupler of the present, two-part electrical connector is identical and may therefore be termed a universal coupler. Electrical connection is made by coupling two universal couplers. Each terminal of the universal coupler is connected to the end of one of two electrical conductors of a conductive pair. As in the case of other electrical connectors that are formed as in pairs (i.e., plug and socket), the present electrical connector may be used to connect an appliance that uses electrical power to a source of electrical power or, alternatively, as an extension cord to deliver electrical power from a remote source to an appliance.

Referring now to FIGS. 1-5, there are illustrated views of the present universal coupler 10 which includes a housing 12, a male terminal 14 and a female terminal 16. Housing 12 is made of a non-conductive material such as a thermosetting polymer and is formed to receive male and female terminals 14 and 16 in specifically-shaped passages 18 and 20, respectively, formed in housing 12. Male terminal 14 and female terminal 16 have different shapes so that male terminal 14 cannot fit properly into passage 20 and female terminal 16 cannot fit properly into passage 18. Male terminal 14 may be hollow 14; female terminal 16 is hollow.

By the phrase "fitting properly", it is meant that a terminal 14 and 16 will seat fully and easily on manual pressure, against frictional resistance, on insertion into passages 18 (for male terminal 14), 20 (for female terminal 16), of housing 12. By the phrase "not fitting properly", it is meant that a terminal will not fully seat or, if it does, only after applying sufficient pressure to distort either housing 12 or the terminal or both.

Male terminal 14 has a top 30 that may be round and is made of a magnetic material, such as a rare earth magnet, and may be nickel-plated, and may also be hollow to reduce the amount of material required to make male terminal 14. Top 30 is oriented and then secured, such as by pulse welding, to a tube 32 to form terminal 14 and to assure that its top surface 34 is its magnetic "north" and is permanently facing away from housing 12 when male terminal 14 has been inserted into passage 18. Tube 32 may have surface features, such as expanded side bars 36, dimensioned to be received in slots 62 of a female fitting 56 as described further below. Tube 32 may also be tapered on the end 38.

Female terminal 16 includes a top 40 and a tube 42. Top 40 and top 30 have different shapes. Top 30 may be round and top 40 may be square. Top 40 is made of a material attracted to a magnet and which may be a magnetizable metal, such as steel that may have a nickel-plated top surface 44 or be made of high-nickel steel so as to not be subject to corrosion when in contact with top surface 34 of male terminal 14. Alternatively, top 40 may be made of a magnet but with the south pole of that magnet oriented away from housing 12. Accordingly, the magnetic top 30 of male terminal 14 will be attracted to top 40 of female terminal 16. Top 40, if not magnetic but magnetizable, will be less expensive than top 30 to make, will avoid orientation issues of north and south, and act as the "keeper" of magnetic top 34 when top surface 34 of male terminal 14 is in contact with top surface 44 of female terminal 16 to preserve the magnetic strength of top 30 of male terminal 14.

Tube 42 of female terminal 16 may have surface features such as slots 46, dimensioned to receive side bars 64 of a male fitting 58 described further below.

Tubes 32, 42, may be made of steel, fiberglass, or carbon fiber, or a combination thereof.

Passages 18 and 20 in housing 12 are formed to receive male terminal 14 and female terminal 16, respectively, not both because passages 18, 20, are formed to correspond to tops 30, 40, respectively. For example, if top 30 is round; passage 18 will have a rounded portion dimensioned to receive top 30; if top 40 is square, passage 20 will have a squared portion dimensioned to receive top 40. Tops 30 and 40 may be made separately and secured to tubes 32, 42, respectively, such as by pulse welding.

It will be clear that the designations male and female are arbitrary and the choice of shapes for tops 30 and 40, as seen in FIG. 1, could be shapes other than the circle and square shown, as long as the choice of the two shapes makes it easy to distinguish between male and female terminals 14, 16, in manufacturing, and avoids accidental use of one in place of the other. While the choice of shapes is ultimately arbitrary, more compact shapes are preferred for top 30 than top 40, since the magnetic top 30 is likely to be more expensive to make, particularly if made of rare earth magnetic material. Tops 30 and 40 may have larger surface areas rather than smaller so that two couplers 10 can more easily align themselves for transferring electrical current. A smaller diameter top 30 and 40 makes accurate self-alignment more difficult.

As best seen in FIG. 3, an electrical conductor 50 comprising a pair of conducting wires 52, 54, may be used to deliver electrical current to coupler 10. Each wire 52, 54, is terminated by a fitting that allows it to be inserted into passages 18, 20, of housing 12, and, moreover, the fitting assures that the polarity of wires 52, 54, will be maintained by coupler 10. Fitting 56 on wire 52 is the same shape as tube 42 of female terminal 16. Likewise, fitting 58 on wire 54 is the same shape as tube 32 of male terminal 14. Thus, fitting 56 will slip over tube 32 of male terminal 14 with side bars 36 of male terminal 14 passing through slots 62 of fitting 56, and fitting 58 will slip into tube 42 of female terminal 16 with side bars 64 of fitting 58 passing through slots 46 of female terminal 16.

Figure 9:
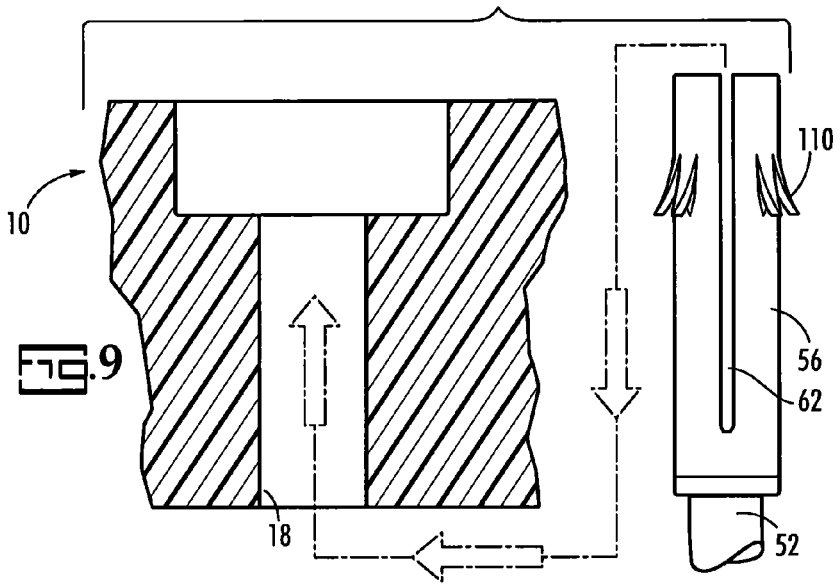
FIG. 9 is a partially-exploded, detail of the tube of the male terminal of a coupler showing a non-removable fitting for use in a coupler housing, according to an embodiment of the present invention.

Optionally, as shown in FIG. 9 in an exploded view of a portion of housing 12, fitting 56 and tube 42 may be made to have features that prevent their removal from coupler 10, such as a one-way punched-out portion 110 that enables insertion of fitting 56 as shown or tube 42 (shown in FIG. 3) into passages 18, 20, of housing 12 but not the removal of fitting 56.

By having top 30 of male terminal 14 as positive and magnetic, and top 40 of female terminal 16 as negative and attracted to a magnet (but preferably not a permanent magnet), wires 52, 54, of electrical conductor 50 can only be inserted into terminals 14, 16, respectively, in the correct way that thereby assures proper polarization for DC polarized loads, such as light-emitting diodes (LEDs).

Using this construction method, the electrical conductor 50 can be machine-built, or even hand-built, or a combination of the two, and the fittings 56, 58, will be properly insertable into tubes 32, 42, during the manufacturing process. Since each of tubes 32, 42, mate with a specific one of fittings 56, 58, no crossing of polarity is possible and thus each universal coupler 10, when assembled, will automatically align in polarity to each other universal coupler 10 so made.

Figure 6:
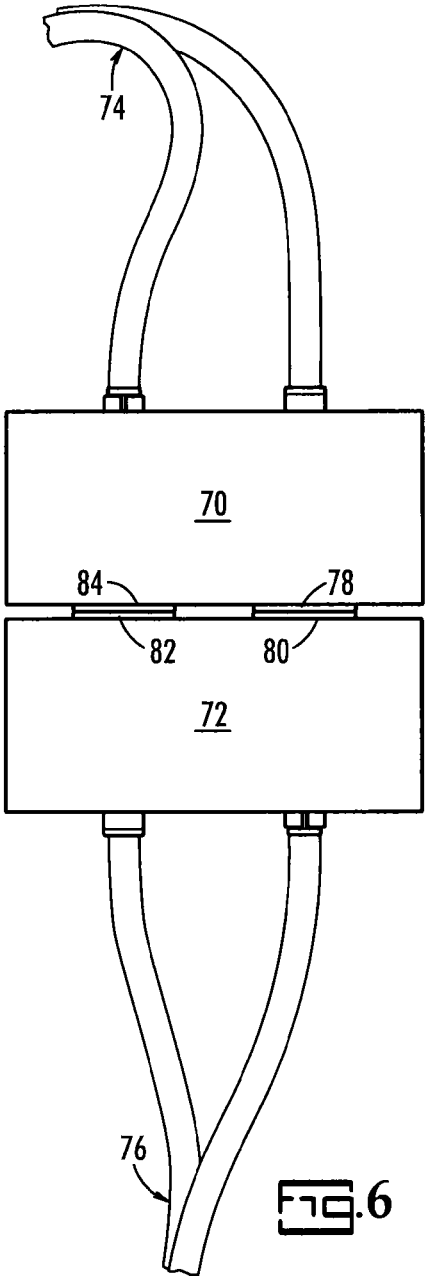
FIG. 6 is a side view of two couplers forming an electrical connector, according to an embodiment of the present invention.

FIG. 6 illustrates two couplers, a first coupler 70 and a second coupler 72, operating as an electrical connector, connecting two electrical conductors, first electrical conductor 74 and second electrical conductor 76, so that electrical current can pass from first conductor 74 to second conductor 76 through couplers 70, 72, respectively. FIG. 6 shows first and second couplers 70, 72 fully and properly oriented with respect to each other and in position to connect first electrical conductor 74 to electrical conductor 76, with a first male terminal 78 of first coupler 70 in contact with a second female terminal 80 of second coupler 72 and a second male terminal 82 of second coupler 72 is in contact with a first female terminal 84 of first coupler 70.

Figure 7A:
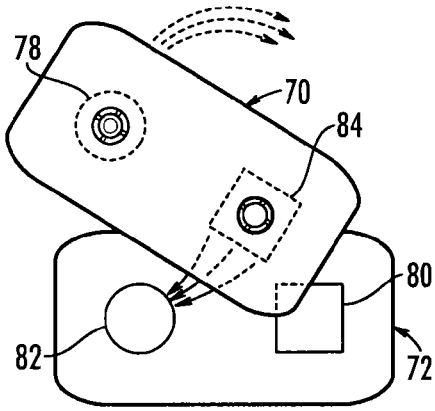
FIGS. 7A, 7B and 7C constitute a series of images showing an example of the self-orienting, sequential movement of two couplers when the top coupler is brought near the bottom coupler in the initial orientation shown, with FIG. 7A showing the top coupler being rotated clockwise with respect to the bottom coupler as the magnetic male terminal of the top coupler is repelled by the magnetic male terminal of the bottom coupler.
Figure 7B:
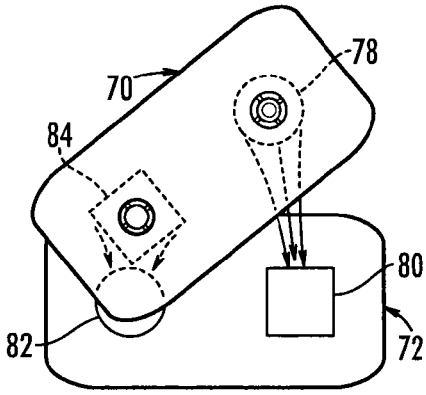
Figure 7C:
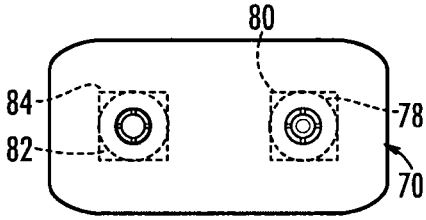

FIGS. 7A, 7B and 7C show an example of the self-alignment process for first and second couplers 70 and 72 in sequence. In FIG. 7A, first coupler 70 is poised over second coupler 72 at what is initially an obtuse angle with respect to its proper orientation (FIG. 6) with respect to second coupler 72. In this orientation, first and second male terminals 78 and 82 are close enough to repel each other, with first coupler 70 moving in a clockwise direction as shown by the arrow in FIG. 7A.

In FIG. 7B, because of the repulsive forces, first and second male terminals 78 and 82 have moved farther apart so that first and second couplers 70, 72 are now oriented in an acute angle with respect to each other. In fact, first and second couplers 70 and 72 have rotated far enough so that the respective attractive forces for each of first and second male terminals 78 and 82 for the corresponding first and second female terminals 80 and 84 begins to assist the repulsive forces between first and second male terminals 78 and 82 in aligning first and second couplers 70, 72, thus drawing first coupler 70 further clockwise and eventually into full alignment with second coupler 72, as seen finally in FIG. 7C, which is a top view of the side view of first and second couplers 70, 72, shown in FIG. 6.

Figure 8:
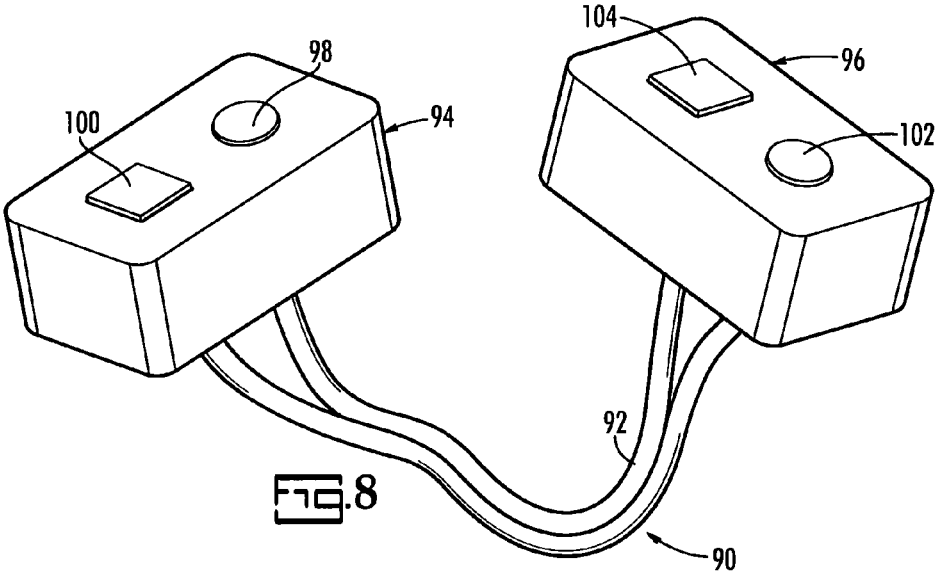
FIG. 8 is a perspective view of a pair of the present couplers joined by a two-wire conductor to serve as an extension cord, according to an embodiment of the present invention.

FIG. 8 illustrates the present electrical connector in the form of an extension cord 90 with a two-wire cord 92 connecting a first coupler 94 and a second coupler 96. Coupler 94 has a male terminal 98 and a female terminal 100 that are joined to a male terminal 102 and a female terminal 104, respectively, so that polarity is preserved. The wires of cord 92 are connected to couplers 94, 96, as described in connection with FIG. 3.

Figure 10:
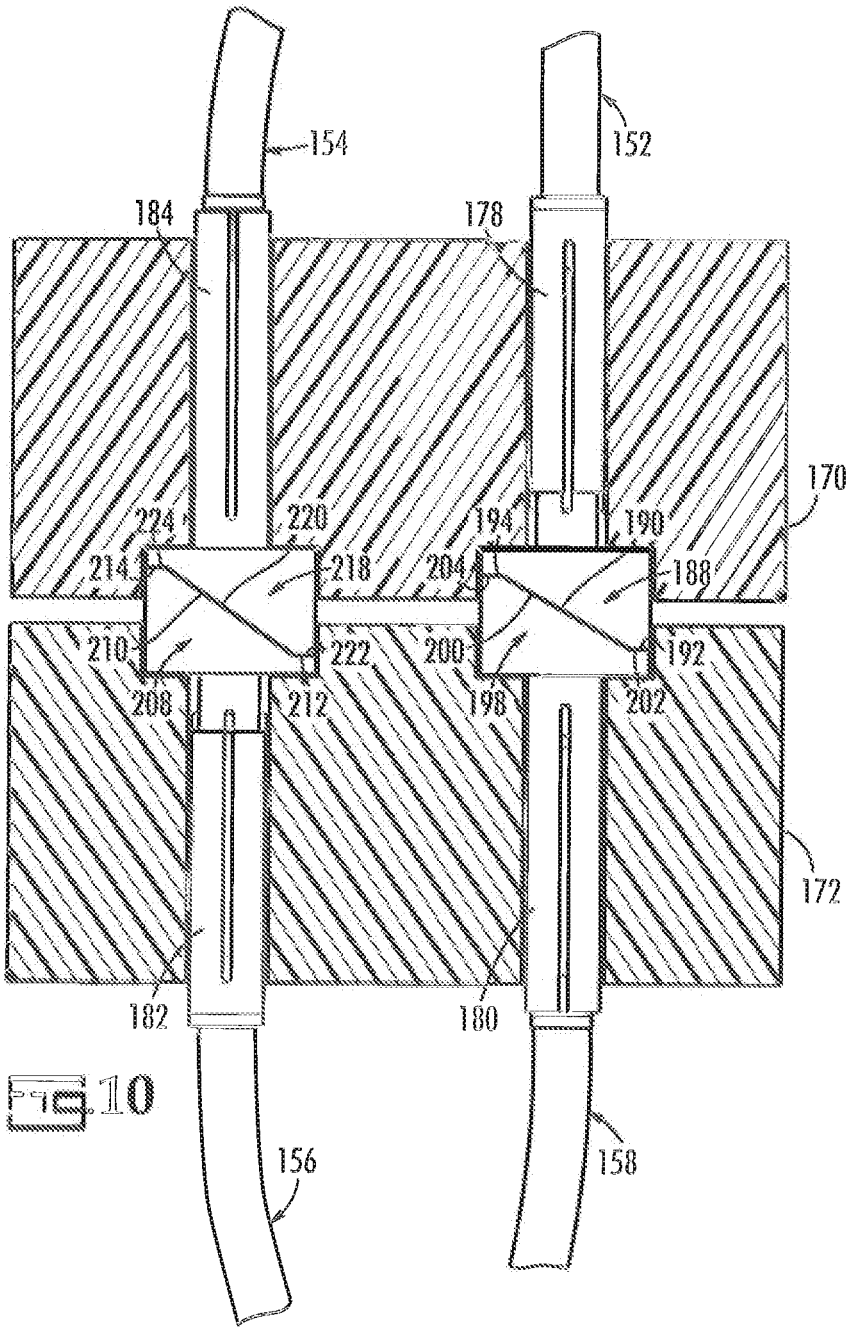
FIG. 10 is a cross-sectional, detailed view of the coupler shown in FIG. 3 having an alternative embodiment of the fitting 58.

FIG. 10 illustrates an alternative embodiment of the present coupler, namely where a first and a second coupler 170, 172, respectively, are in electrical connection. FIG. 10 illustrates in cross section first coupler 170 and second coupler 172 held together by the magnetic attraction between their respective terminals. Wires 152 and 154 are connected to a first male terminal 178 and first female terminal 184, respectively, of first coupler 170; wires 156 and 158 are connected to a second male terminal 182 and second female terminal 180, respectively, of second coupler 172 In particular, first male terminal 178 of first coupler 170 is attracted to second female terminal 180 of second coupler 172, and second male terminal 182 of second coupler 172 is attracted to first female terminal 184 of first coupler 170.

First male terminal 178 has a top 188 with a top surface 190 that is not flat but rather is angled with respect to the interface between coupler 170 and 172, and may have brakes 192, 194, in the otherwise angled top surface 190. The angle of the top surface of top 188 means that the surface is pitched, that is, it lies in a plane different than the interface between said first and said second coupler 170, 172. The term brakes means that the pitch of said top surface is broken toward the edges of the top surfaces, that is, it is not angled all the way to the edges but rather assumes the same angle of the plane of the interface between the first and second couplers 170, 172. A top 198 of second female terminal 180 has a correspondingly angled top surface 200 with brakes 202, 204 so that top surface 190 and 200 may fully engage.

Similarly, second male terminal 182 has a top 208 with an angled top surface 210 with brakes 212 and 214, and first female terminal 184 has a top 218 with an angled top surface 220 with brakes 222 and 224 so that top surface 210 and top surface 220 fully engage.

The angles of top surfaces 190, 200, 210 and 220 need only be slight angles to provide an interference with the bodies of couplers 170 and 172 against lateral movement as shown in FIG. 10, and thereby to help lock the engaged first and second terminals 178, 180 respectively, in place and first and second terminals 184, 182, respectively, in place against lateral movement.

Some wire harnesses may have three or more wires, with the additional wires for use with other power options or data communication lines to loads or control functions. In these cases the harness will use magnetic repulsion to enable an electrical connector to self-align while accommodating these additional harness connections by a linear arrangement of conductors with the positive and negative poles flanking a third pole that is automatically aligned when the two poles are aligned. The coupler for these additional connections will require additional, unique terminal passages shaped to allow only the properly-shaped terminals from the cord to be plugged in, preserving the high level of quality assurance, at a sub-assembly level, in or out of the factory environment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention. It will be apparent to those skilled in the art of physical therapy that many changes and substitutions may be made to the foregoing description of preferred embodiments without departing from the spirit and scope of the present invention, which is defined by the appended claims.

What is claimed is:

1. A connector for conducting electricity, said connector comprising, (a) two universal couplers, a first universal coupler and a spaced-apart second universal coupler, each universal coupler of said two universal couplers including (i) a housing having a first passage and a spaced-apart second passage formed therein, and (ii) one male terminal and one female terminal, said first passage being formed to receive said one male terminal but not said one female terminal, said second passage being formed to receive said one female terminal but not said one male terminal, wherein said one male terminal has a male top made of a magnetic material, said one male terminal having an outer surface oriented so that only one pole of said magnetic material is permanently facing away from said housing when said one male terminal is in said first passage, and said one female terminal has a female top made of a material attracted to a magnet, said female top of said one female terminal having an outer surface facing away from said housing when said one female terminal is in said second passage, and wherein said one male terminal has a first tube electrically connected to said male top of said one male terminal, and said one female terminal has a second tube electrically connected to said female top of said one female terminal, wherein said first universal coupler of said two universal couplers is identical to and interchangeable with said second universal coupler of said two universal couplers; and (b) two conductors running between said two couplers, a first conductor of said two conductors running from said one male terminal of said first universal coupler to said one male terminal of said second universal coupler, and a second conductor of said two conductors running from said one female terminal of said first universal coupler to said one female terminal of said second universal coupler;

wherein said top surfaces have a pitch at an angle with respect to the plane of the interface between said universal coupler and any second universal coupler engaged therewith, and wherein said angled top surfaces each include a brake formed by said pitch not being angled all the way to the edges of said top surfaces, said brakes causing the angled top surfaces of said male terminals to be fully engaged with the angled top surfaces of said female terminals, and said fully engaged angled surfaces providing an interference with the bodies of said couplers that locks the engaged first and second terminals, respectively, in place against lateral movement.

2. An electrical connector, comprising, (a) two universal couplers, a first universal coupler and a spaced-apart second universal coupler, each universal coupler of said two universal couplers including (i) a housing having a first passage and a spaced-apart second passage formed therein, and (ii) one male terminal and one female terminal, said first passage being formed to receive said one male terminal but not said one female terminal, said second passage being formed to receive said one female terminal but not said one male terminal, wherein said one male terminal has a male top made of a magnetic material, said one male terminal having an outer surface oriented so that only one pole of said magnetic material is permanently facing away from said housing when said one male terminal is in said first passage, and said one female terminal has a female top made of a material attracted to a magnet, said female top of said one female terminal having an outer surface facing away from said housing when said one female terminal is in said second passage, and wherein said one male terminal has a first tube electrically connected to said male top of said one male terminal, and said one female terminal has a second tube electrically connected to said female top of said one female terminal, wherein said first universal coupler of said two universal couplers is identical to and interchangeable with said second universal coupler of said two universal couplers; and (b) a conductive female fitting for connecting to a terminal end of a first conductor, and a conductive male fitting for connection to a terminal end of a second conductor, wherein said female fitting is adapted to receive therein said male tube of said one male terminal, and said male fitting is adapted to be received within said female tube of said one female terminal, said female fitting having a shape preventing reception of said female tube, and said male fitting having a shape preventing its reception within said male tube to assure that the polarity of the first and second conductors will be maintained by said terminals.

3. The electrical connector as recited in claim 2 further comprising two conductors running between said two couplers, a male conductor of said two conductors running from said one male terminal of said first universal coupler to said one male terminal of said second universal coupler, and a female conductor of said two conductors running from said one female terminal of said first universal coupler to said one female terminal of said second universal coupler;

wherein said two conductors each has a first end and an opposing second end, said first and second ends of said male conductor having said male fittings on the first and second ends thereof, and said first and second ends of said female conductor having said female fittings on the first and second ends thereof, wherein said male fittings are received into said first passages of said first and second couplers, and said female fittings are received into said second passages of said first and said second couplers.

4. The electrical connector as recited in claim 3 wherein said one female terminals and said first fittings are formed so as not to be removable from said housings once inserted therein.

5. The electrical connector as recited in claim 2, wherein each one female terminal of said one female terminals has a female top made of nickel-plated aluminum or steel.

6. The electrical connector as recited in claim 2, wherein said male tops of said one male terminals and said female tops of said one female terminals are made in mutually exclusive shapes.

7. The electrical connector as recited in claim 2, wherein said male tops of said one male terminals are round and said female tops of said one female terminals are square.

8. The electrical connector as recited in claim 2, wherein said female fitting is interchangeable with said female tube, and said male fitting is interchangeable with said male tube.

9. The electrical connector as recited in claim 2 further comprising two conductors running between said two couplers, a first conductor of said two conductors running from said one male terminal of said first universal coupler to said one male terminal of said second universal coupler, and a second conductor of said two conductors running from said one female terminal of said first universal coupler to said one female terminal of said second universal coupler.

10. A universal coupler for conducting electricity, said universal coupler comprising:

(a) a housing having two spaced-apart passages;

(b) one male terminal received in a first passage of said two spaced-apart passages, said one male terminal having a male top made of a magnetic material and a male tube in electrical connection with said male top, said male top of said one male terminal having a top surface oriented so that only one pole of said magnetic material is facing away from said housing when said one male terminal is in the first passage of said two spaced-apart passages, said male top and said tube of said male terminal being electrically conducting; and (c) one female terminal received in a second passage of said two spaced apart passages, said one female terminal having a female top made of a material attracted to said magnetic material and a female tube in electrical connection with said female top, said female top of said female terminal having a top surface facing away from said housing when said female terminal is in the second passage of said two spaced-apart passages, said top and said tube of said female terminal being electrically conducting, wherein, when a second universal coupler identical to said universal coupler is moved proximate to said universal coupler, said second universal coupler self-aligns with said universal coupler, said one male terminal of said universal coupler and one male terminal of said second universal coupler repelling each other as said one male terminal of said universal coupler attracts one female terminal of said second universal coupler and said one female terminal of said universal coupler attracts said one male terminal of said second universal to engage together at an interface to form an electrically conducting connector that conducts electricity from said universal coupler to said second universal coupler across said interface, and (d) a conductive female fitting for connecting to a terminal end of a first conductor, and a conductive male fitting for connecting to a terminal end of a second conductor, wherein said female fitting is adapted to receive therein said male tube of said one male terminal, and said male fitting is adapted to be received within said female tube of said one female terminal, said female fitting having a shape preventing reception of said female tube, and said male fitting having a shape preventing reception within said male tube to assure that the polarity of the first and second conductors will be maintained by said terminals.

11. The universal coupler as recited in claim 10, wherein said male top of said one male terminal and said female top of said one female terminal have different shapes.

12. The universal coupler as recited in claim 11, wherein said different shapes are mutually exclusive shapes.

13. The universal coupler as recited in claim 10, wherein said male and female tops of said one male and said one female terminals, respectively, are nickel-coated.

14. The universal coupler as recited in claim 10, wherein said male top of said one male terminal is made of a rare earth magnet.

15. The universal coupler as recited in claim 14, wherein said male top of said one male terminal is hollow.

16. The universal coupler as recited in claim 14, wherein said female top of said one female terminal is made of steel or aluminum.

17. The universal coupler as recited in claim 10, wherein said female fitting is interchangeable with said female tube, and said male fitting is interchangeable with said male tube.

18. The universal coupler as recited in claim 10, further comprising (a) a housing having two spaced-apart passages;

(b) one male terminal received in a first passage of said two spaced-apart passages, said one male terminal having a male top made of a magnetic material and a male tube in electrical connection with said male top, said male top of said one male terminal having a top surface oriented so that only one pole of said magnetic material is facing away from said housing when said one male terminal is in the first passage of said two spaced-apart passages, said male top and said tube of said male terminal being electrically conducting; and (c) one female terminal received in a second passage of said two spaced apart passages, said one female terminal having a female top made of a material attracted to said magnetic material and a female tube in electrical connection with said female top, said female top of said female terminal having a top surface facing away from said housing when said female terminal is in the second passage of said two spaced-apart passages, said female top and said tube of said female terminal being electrically conducting;

wherein, when a second universal coupler identical to said universal coupler is moved proximate to said universal coupler, said second universal coupler self-aligns with said universal coupler, said one male terminal of said universal coupler and one male terminal of said second universal coupler repelling each other as said one male terminal of said universal coupler attracts one female terminal of said second universal coupler and said one female terminal of said universal coupler attracts said one male terminal of said second universal to engage together at an interface to form an electrically conducting connector that conducts electricity from said universal coupler to said second universal coupler across said interface; and, wherein said top surfaces have a pitch at an angle with respect to the plane of the interface between said universal coupler and any second universal coupler engaged therewith, and wherein said angled top surfaces each include a brake formed by said pitch not being angled all the way to the edges of said top surfaces, said brakes causing the angled top surfaces of said male terminals to be fully engaged with the angled top surfaces of said female terminals, and said fully engaged angled surfaces providing an interference with the bodies of said couplers that locks the engaged first and second terminals, respectively, in place against lateral movement.

* * * * *